United States Patent [19]

Ullman

[11] Patent Number: 4,649,355

[45] Date of Patent: Mar. 10, 1987

[54] ROTARY MICROWAVE SWITCH

[75] Inventor: Wolfgang Ullman, Backnang, Fed. Rep. of Germany

[73] Assignee: ANT Nachrichtentechnik GmbH, Backnang, Fed. Rep. of Germany

[21] Appl. No.: 736,697

[22] Filed: May 22, 1985

[30] Foreign Application Priority Data

May 25, 1984 [DE] Fed. Rep. of Germany ..... 3419534

[51] Int. Cl.[4] ..... H01P 1/10

[52] U.S. Cl. ..... 333/106; 333/248

[58] Field of Search ..... 333/106, 107, 259, 262; 200/153 S

[56] References Cited

U.S. PATENT DOCUMENTS 3,155,923 11/1964 Persson ..... 333/106 X
3,243,733 3/1966 Hosman ..... 333/106
3,969,690 7/1976 Hansen et al. ..... 333/107
4,201,963 5/1980 Welti ..... 333/106

FOREIGN PATENT DOCUMENTS 720589 3/1980 U.S.S.R. ..... 333/106

*Primary Examiner*—Paul Gensler
*Attorney, Agent, or Firm*—Spencer & Frank

[57] ABSTRACT

A rotary microwave switch is composed of a housing having a side wall, a housing interior cavity, and a plurality of waveguide ports distributed around the side wall. A rotor having at least one rotor cavity is mounted within the housing interior cavity and an electrically conductive plate is fastened to the rotor and has at least one gap constituting a waveguide section. The gap is in communication with the housing interior cavity and the rotor cavity. The rotor is mounted for rotation, relative to the housing, into at least one operative position for causing the waveguide section to establish a signal conducting connection between two of the ports.

6 Claims, 2 Drawing Figures

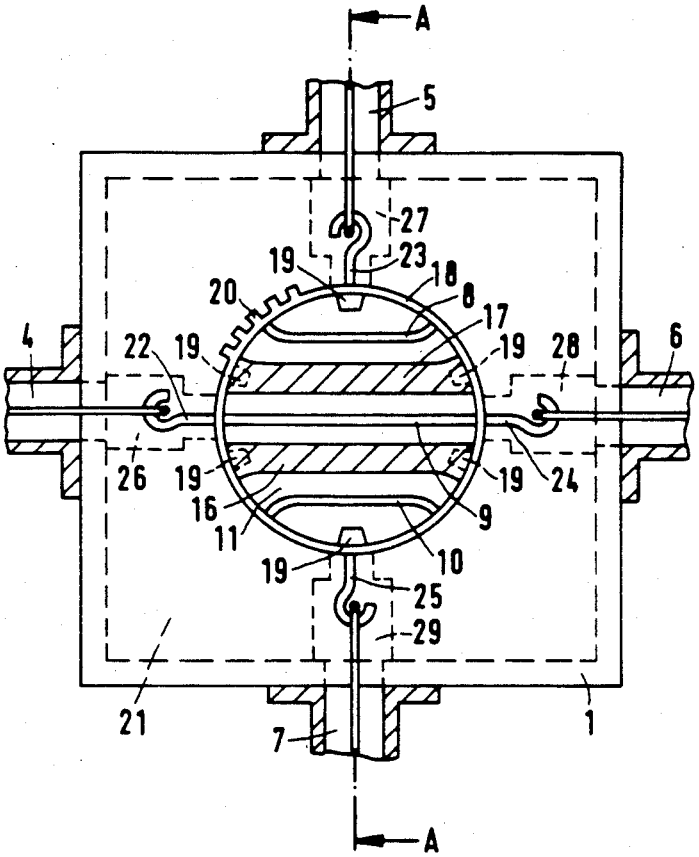
FIG. 1
FIG. 2
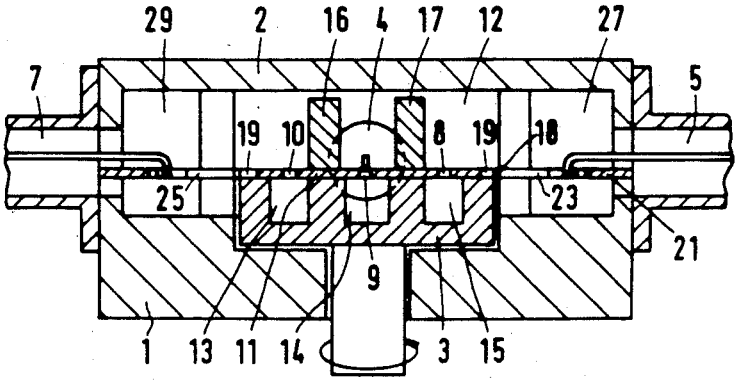

ROTARY MICROWAVE SWITCH

BACKGROUND OF THE INVENTION

The present invention relates to a rotary microwave switch composed of a housing having a rotor-accepting cavity and a plurality of waveguide ports and a rotor disposed in the housing cavity and equipped with at least one waveguide, with this waveguide producing, at a certain position of the rotor, a signal connection between two waveguide ports.

Such a rotary switch is disclosed in U.S. Pat. No. 4,242,652, issued to Shishido et al. Such rotary switches having, e.g. four or even six signal inputs and outputs, respectively, are used, for example, to connect standby devices, such as transmitters and receivers, into a communications transmission system in place of malfunctioning primary devices.

Particularly in communications satellites, high operational reliability is required. For that reason, standby devices must be provided which can be used as substitutes for defective devices. For the switches that switch in these standby devices there exist the requirements, as for all other component groups in a satellite, for low weight and small size.

The rotary microwave switch disclosed in the above-cited patent is designed entirely on the basis of rectangular waveguide technology involving the use of closed waveguide sections; this applies for the waveguide ports in the stationary housing as well as for the waveguides on the rotor. Because the switch design is based entirely on rectangular waveguide technology, it is relatively heavy and has relatively large dimensions.

SUMMARY OF THE INVENTION

It is therefore an object of the present invention to provide a rotary microwave switch of the above-mentioned type which does not require much space and is lighter in weight than prior art rotary switches.

These and other objects are achieved, according to the present invention, by a rotary microwave switch composed of a housing having a side wall, a housing interior cavity, and a plurality of waveguide ports distributed around the side wall; a rotor having at least one rotor cavity and mounted within the housing interior cavity; and means associated with the rotor and defining at least one waveguide section; the rotor being mounted for rotation, relative to the housing, into at least one operative position for causing the waveguide section to establish a signal conducting connection between two of the ports; wherein the means defining at least one waveguide section are composed of an electrically conductive plate fastened to the rotor and having at least one gap constituting the at least one waveguide section, the gap being in communication with the housing interior cavity and the rotor cavity.

The rotary microwave switch according to the present invention advantageously has low forward attenuation, high decoupling between switched-through and not-switched-through waveguides and good matching.

The invention will now be described in greater detail with reference to an embodiment which is illustrated in the drawing.

BRIEF DESCRIPTION OF THE DRAWING

FIG. 1 is a top plan view partly in cross section of a preferred embodiment of a rotary microwave switch according to the invention.

FIG. 2 is a cross-sectional view along line A—A of FIG. 1.

DESCRIPTION OF THE PREFERRED EMBODIMENTS

The rotary microwave switch shown in FIGS. 1 and 2 is composed of a stationary housing having a lower portion 1 and a cover 2 covering lower portion 1. A rotor 3 is rotatably mounted in a cavity provided in the housing.

Four waveguide ports are provided at the exterior faces of housing 1, 2; here these ports are coaxial conductors 4, 5, 6 and 7, whose outer conductors are flanged to respective side walls of the housing and whose inner conductors lead into the interior of the housing.

Signal connections between any two of the four waveguide ports are established by means of waveguides disposed on rotor 3.

In order to be able to switch through all possible combinations of waveguide connections, three waveguide sections are required on rotor 3. These three waveguide sections are defined by three gaps 8, 9 and 10 formed in an electrically conductive plate 11 fastened to rotor 3. The two gaps 8 and 10 are offset from the center of plate 11 and have a generally arcuate curvature so that, depending on the angular position of the rotor, they establish signal connections between respectively adjacent waveguide ports, i.e., either one of gaps 8 and 10 can connect coaxial conductors 4 and 5 or 5 and 6 or 6 and 7 or 7 and 4. Gap 9 is linear and extends through the axis of rotor 3 between outer gaps 8 and 10. Gap 9 can form either one of two signal paths, depending on the respective position of rotor 3, i.e. between coaxial conductor 4 and coaxial conductor 6, or between coaxial conductor 5 and coaxial conductor 7.

In order for microwaves to be able to propagate along gaps 8, 9 and 10 in electrically conductive plate 11, housing cover 2 is provided with a generally circular cavity 12 and rotor 3 is provided with three generally parallel, elongate cavities 13, 14 and 15. Cavity 12 is above gaps 8–10 and cavities 13–15 are below those gaps. Cavity 12 is adapted to the diameter of rotor 3 and cavities 13, 14 and 15 are formed by channels cut in rotor 3, each below one of gaps 8, 9 and 10.

To avoid signal overcoupling, shielding bars 16 and 17 are provided on electrically conductive plate 11 between respective pairs of gaps 8, 9 and 10.

Under certain circumstances, the danger exists that waves may propagate between rotor 3 and the stationary housing 1, 2, resulting in cross-coupling between switched and not switched waveguide ports. Most of these waves are blocked already by shielding bars 16 and 17. In the present embodiment, a plurality of cuts 19 are made in the edge of plate 11, with these cuts being dimensioned so that they block the waves in a separating gap 18 between the side wall of rotor 3 and housing lower portion 1. A similar blocking effect is produced by a tooth-like blocking structure 20 which, as indicated in FIG. 1, is provided at the inner edge of a metal sheet 21 clamped in between lower housing portion 1 and upper housing portion 2 and surrounding plate 11 on rotor 3.

Electrically conductive metal sheet 21 is provided with four elongate gaps 22, 23, 24 and 25, which are coupled with the center conductors of coaxial conductors 4, 5, 6 and 7 and extend to the inner edge of metal sheet 21 to thus constitute an extension of waveguides 8, 9 and 10 on rotor 3 which are aligned therewith. Cavities 26, 27, 28 and 29 are cut in lower housing member 1 and in cover 2 below and above gaps 22, 23, 24 and 25 in metal sheet 21.

Coupling of coaxial conductors 4, 5, 6 and 7 to gaps 22, 23, 24 and 25 is effected in the simplest manner by conductively contacting each center conductor with metal sheet 21 in the vicinity of a respective gap 22–25. Instead of the illustrated coaxial form, the waveguide ports may also be designed as rectangular waveguide or planar conductors, e. g. strip, slit or fin conductors.

Advisably, materials having the same coefficient of thermal expansion will be used for all parts of the rotary microwave switch so that no stresses develop between housing and rotor due to changes in temperature. By way of example, all parts can be of aluminum.

One exemplary embodiment of a rotary microwave switch according to the invention has the following dimensions:

diameter of the rotor 3: 24 mm
width of gaps 8, 9, 10: 0.5 mm
width of separating gap 18: 20 μm
height of cavities 12, 13, 14, 15, 26, 27, 28, 29: 4 mm
thickness of plates 11, 21: 1.3 mm
width of recesses 19: 2.5 mm
depth of recesses 19: 2.5 mm The tooth-like blocking structure 20 on sheet 21 extends uniformly around the circumference of plate 11. The separating gap 18 which is present around the circumference of rotor 3 exists additionally adjacent the bottom of rotor 3.

It will be understood that the above description of the present invention is susceptible to various modifications, changes and adaptations, and the same are intended to be comprehended within the meaning and range of equivalents of the appended claims.

What is claimed is:

1. A rotary microwave switch comprising: a housing having a plurality of side walls, a housing interior cavity, and a plurality of waveguide ports distributed around said side walls; a rotor having at least one rotor cavity and mounted within said housing interior cavity; and means associated with said rotor and defining at least one waveguide section; said rotor being mounted for rotation, relative to said housing, into at least one operative position for causing said waveguide section to establish a signal conducting connection between two of said ports; wherein said means defining at least one waveguide section comprise an electrically conductive plate fastened to said rotor and having at least one gap constituting said at least one waveguide section, said gap being in communication with said housing interior cavity and said rotor cavity.

2. Rotary microwave switch as defined in claim 1, wherein said housing, said rotor and said electrically conductive plate are made of materials having substantially identical coefficients of thermal expansion.

3. Rotary microwave switch as defined in claim 2, wherein said housing, said rotor and said electrically conductive plate are made of aluminum.

4. Rotary microwave switch as defined in claim 1 wherein: said rotor has three gaps each constituting a respective waveguide section, and three rotor cavities each communicating with a respective one of said gaps, wherein said three gaps include two curved gaps and a linear gap located between said curved gaps; there are four said waveguide ports; and said rotor is rotatable into respective operative positions for establishing a signal conductive connection between any two of said waveguide ports via a respective one of said waveguide sections.

5. Rotary microwave switch as defined in claim 4 further comprising two shielding bars mounted on said electrically conductive plate and each located between said linear gap and a respective one of said curved gaps.

6. Rotary microwave switch as defined in claim 1 wherein said rotor has a circumferential wall which is separated from said housing by an annular space, and said electrically conductive plate has a circumferential edge provided with recesses located for preventing the propagation of microwaves across said annular space between said rotor and said housing.

* * * * *